US009762996B2

(12) United States Patent
Combet et al.

(10) Patent No.: US 9,762,996 B2
(45) Date of Patent: Sep. 12, 2017

(54) SOUND SYSTEM WITH IMPROVED ADJUSTABLE DIRECTIVITY

(71) Applicant: L-ACOUSTICS, Marcoussis (FR)

(72) Inventors: Christophe Combet, Marcoussis (FR); Christian Heil, Marcoussis (FR)

(73) Assignee: L-ACOUSTICS, Marcoussis (FR)

( * ) Notice: Subject to any disclaimer, the term of this patent is extended or adjusted under 35 U.S.C. 154(b) by 0 days.

(21) Appl. No.: 15/032,483

(22) PCT Filed: Oct. 30, 2013

(86) PCT No.: PCT/FR2013/052604

§ 371 (c)(1),
(2) Date: Apr. 27, 2016

(87) PCT Pub. No.: WO2015/063377

PCT Pub. Date: May 7, 2015

(65) Prior Publication Data

US 2016/0277830 A1 Sep. 22, 2016

(51) Int. Cl.

| | |
|---|---|
| ***H04R 1/02*** | (2006.01) |
| ***H04R 1/32*** | (2006.01) |
| ***H04R 3/04*** | (2006.01) |
| *H04R 1/34* | (2006.01) |
| *H04R 1/40* | (2006.01) |

(52) U.S. Cl.

CPC ..... *H04R 1/323* (2013.01); *H04R 1/025* (2013.01); *H04R 3/04* (2013.01); *H04R 1/345* (2013.01); *H04R 1/403* (2013.01); *H04R 2201/403* (2013.01)

(58) Field of Classification Search

CPC ..... H04R 1/345; H04R 1/403; H04R 3/14; H04R 2201/40; H04R 2203/12

See application file for complete search history.

(56) References Cited

U.S. PATENT DOCUMENTS

| | | | | |
|---|---|---|---|---|
| 7,912,234 | B1 * | 3/2011 | Graber | G10K 11/28 181/175 |
| 8,121,336 | B2 * | 2/2012 | Hutt | H04R 1/025 381/387 |

(Continued)

FOREIGN PATENT DOCUMENTS

| | | |
|---|---|---|
| EP | 1635606 A1 | 3/2006 |
| JP | 09037378 | 2/1997 |
| JP | 2009118376 | 5/2009 |

OTHER PUBLICATIONS

International Search Report for PCT/FR2013/052604, ISA/EP, Rijswijk, NL, mailed Jul. 9, 2014.

(Continued)

*Primary Examiner* — Curtis Kuntz
*Assistant Examiner* — Ryan Robinson
(74) *Attorney, Agent, or Firm* — Harness, Dickey & Pierce, P.L.C.

(57) ABSTRACT

The disclosure includes a sound system comprising at least one Digital Signal Processor control module, acting on a signal to the high-frequency transducer and on a signal to a mid-frequency transducer so as to apply, in a common frequency range, at least one magnitude parameter as well as at least one phase parameter so as to produce a directivity along the same angular sector as a directivity produced by the orientable shutters.

10 Claims, 1 Drawing Sheet

(56) References Cited

U.S. PATENT DOCUMENTS

| | | | | |
|---|---|---|---|---|
| 8,369,533 | B2 * | 2/2013 | Konagai | H04R 3/12 381/17 |
| 2005/0207593 | A1 | 9/2005 | Praestgaard et al. | |
| 2006/0062402 | A1 | 3/2006 | Heil | |
| 2006/0169530 | A1 | 8/2006 | Noselli et al. | |
| 2010/0272295 | A1 * | 10/2010 | Nakatani | H04R 1/26 381/160 |
| 2012/0328135 | A1 * | 12/2012 | De Bruijn | H04R 1/323 381/300 |
| 2016/0073195 | A1 * | 3/2016 | Adamson | H04R 1/26 381/338 |
| 2017/0013348 | A1 * | 1/2017 | Arneson | H04R 1/403 |

OTHER PUBLICATIONS

Office Action in corresponding Japanese application 2016-551055 dated Jun. 23, 2017, 3 pgs.

* cited by examiner

SOUND SYSTEM WITH IMPROVED ADJUSTABLE DIRECTIVITY

CROSS-REFERENCE TO RELATED APPLICATIONS

This application is a 371 U.S. National Stage of International Application No. PCT/FR2013/052604, filed Oct. 30, 2013, the entire disclosures of which are incorporated herein by reference.

The invention concerns the control of the directivity of electroacoustic sound sources, whether they are used in professional, institutional or domestic sound systems.

The electroacoustic sound sources are commonly called « acoustic speaker », « loudspeaker system », « source line » or « sound speaker or system ».

Among the essential characteristics that qualify a sound source, the directivity, and more particularly the way of controlling the latter over a defined portion of the sound spectrum, plays a crucial role in the professional applications. Directivity generally designates an angle corresponding to the angular sector for which the Sound Pressure Level or SPL is constant over a frequency range specified by the manufacturer. Thus, it will be said that such sound source presents, for example, a horizontal directivity of 90°, controlled from 1 kHz to 10 kHz. According to international conveniences, the term « controlled » implies that the SPL is constant within +/−3 dB over a 90° sector between 1 kHz and 10 kHz, whereas the attenuation of the SPL outside this angular sector has to be as high as possible, typically higher than 6 dB.

In a professional sound system, the directivity of a sound source distinguishes two planes, the horizontal plane and the vertical plane, for which this characteristic generally presents different values. The art of controlling the directivity of sound sources goes back to the origins of loudspeakers.

Nowadays, there are two independent methods capable of controlling the directivity of sound sources. The first is conventionally mechanical: it is based very largely on the use of sound horns, and/or on the array-shaped arrangement of several transducers. « Sound sources » products belonging to this class, whether in the professional sector or not, present, for a given horizontal or vertical plane, one single directivity, set once and for all by the material configuration of the components of the acoustic speaker. Thus, the choice of the transducers, their connection frequency, the type of horn or waveguide mounted in front of the orifice of compression-chamber motors or electrodynamic loudspeakers thus determines the directivity characteristics of the sound source over a more or less extended spectral band.

It should be recalled that only medium and treble frequencies can be controlled, knowing that all the frequencies, whose wavelength largely exceeds the physical dimensions of the sound source object, are not known to be controllable due to unavoidable physical laws. Thus, it is illusory to control frequencies below 100 Hz, namely a wavelength larger than 3.4 meters, if the acoustic speaker is a cube of 30 cm edge. At medium frequencies, that is to say for medium loudspeakers whose frequencies are typically comprised between about 200 Hz and about 1 kHz, it is possible to obtain a satisfactory control by means of an ad hoc arrangement of the transducers, by acting on the interferences between several loudspeakers. At high frequencies, that is to say for treble loudspeakers whose frequencies are typically comprised between about 1 kHz and about 10 kHz, it is necessary to mount waveguides and/or horns in front of the orifice or mouthpiece of the treble loudspeakers often called « tweeters », or compression-chamber motors in order to obtain the desired directivity by the shape of the guide and/or horn.

The interest of the mechanical approach lies in its design simplicity and moderate cost, thereby providing interesting results at the medium and high frequencies. The drawback due to mechanical fixity is that it is not possible to provide the user with several choices of directivity in the same product.

This drawback has led to the introduction of variable-geometry horns or waveguides, by inserting orientable flaps at the output of waveguides, adjusted by the user depending on his choice. There is also known a device bearing the name of Outline MINI COM.P.A.S.S.—registered trademark—which belongs to the first class of mechanically-acting sound sources, with orientable elements, in which the medium transducers are mounted. Unfortunately, since such settings act only on some physical parameters of the medium/treble set, they present only but a limited level of performance through the entire desired frequency range.

The second way of controlling directivity has appeared during the last ten years, it is based on the electronic resort provided by DSP-type components, DSP standing for Digital Signal Processor. Transducers, which are often identical, are associated according to a predefined physical arrangement. The transducers operate over a common frequency range chosen by the manufacturer. Thanks to the DSP component, are applied to at least one of the transducers, magnitude and phase parameters, in other words, parameters of filtering, gain, phase shifting, delay, enabling to modify and control the directivity of the loudspeaker assembly, considered as a complex sound source. The interest of this approach lies in its ability to provide different directivities for the same physical configuration. This always implies a significant number of transducers in order to obtain a high quality of control. Its drawback consists in its high cost because it typically implements a transducer-amplification DSP component and it implies a near impossibility of addressing the issue of the control of the very high frequencies, as soon as the wavelength becomes smaller than the size of each transducer, typically above 4 kHz.

Thus, the device presented in the document EP 1 635 606 belongs to the first class of mechanically-acting sound sources, with adjustable flaps acting mechanically and acoustically on the medium and treble transducers. The method uses different DSP parameters for the settings of different flaps, for the sole purpose of linearizing the frequency response. There is no frequency range common to the medium and treble transducers. The connection frequency between medium and treble transducers is fixed, thus independent from the orientation of the flaps.

The aim of the invention is to overcome the drawbacks of the known loudspeaker systems, by providing a system which presents a particularly effective directivity with a sufficiently simple preparation.

This aim is achieved according to the invention thanks to a sound system, comprising at least one treble sound transducer and at least one medium sound transducer, orientable flaps acting on a sound emission of the treble sound transducer so as to produce a sound emission directivity of the treble sound transducer over a chosen angular sector, characterized in that it is configured so that the medium sound transducer and the treble sound transducer emit over a common frequency range and it comprises at least one Digital Signal Processor type control module acting on a signal addressed to the treble sound transducer and on a signal addressed to the medium sound transducer so as to apply in the common frequency range at least one magnitude parameter on the treble sound transducer (1) and/or on the medium sound transducer as well as at least one phase parameter on the treble sound transducer and/or on the medium sound transducer so as to produce a sound emission directivity of the pair constituted by the treble sound transducer and by the medium sound transducer over the same chosen angular sector as the directivity produced by the orientable flaps.

Advantageously, the orientable flaps and the DSP-type control module are configured so that each of them generates a presence of the sound waves according to a substantially constant sound level within said chosen angular sector, the orientable flaps and the DSP-type control module being configured so that they attenuate the sound waves in every angle external to said chosen angular sector according to an attenuation higher than 6 dB relative to the highest sound level within said chosen angular sector.

Advantageously, the sound system is configured so that the common frequency range is variable based on the orientation of the orientable flaps.

Advantageously, the sound system comprises at least two medium sound transducers and at least one treble sound transducer, the medium sound transducers being disposed on either side of the treble sound transducer.

Advantageously, the sound system includes a case surrounding, at least partially, one of the flaps, said at least one of the flaps presenting a surface oriented opposite a sound stream emitted by said treble sound transducer and a surface oriented away from the sound stream emitted by said treble sound transducer, the case forming obstacle in front of the surface of the flap (6) oriented away from the sound stream emitted by the treble sound transducer so as to protect this surface from an impact made by a foreign object.

Advantageously, said at least one medium sound transducer includes a substantially conical-shaped movable diaphragm and the case of said at least one flap is shaped so as to conform to a portion of the substantially conical shape of the diaphragm.

Advantageously, the sound system constitutes a portable sound system.

Advantageously, the sound system includes at least two bass sound transducers and said at least two bass sound transducers are disposed on either side of an assembly constituted by said at least one treble sound transducer and said at least two medium sound transducers.

Advantageously, the sound system includes at least one waveguide which conveys sound waves emitted by the treble sound transducer.

Advantageously, the sound system includes a slot through which are emitted the sound waves produced by the treble sound transducer, said at least two medium sound transducers being disposed on either side of the slot.

Other characteristics, aims and advantages of the invention will appear upon reading the detailed description that follows, with reference to the appended figures on which:

Figure 1:
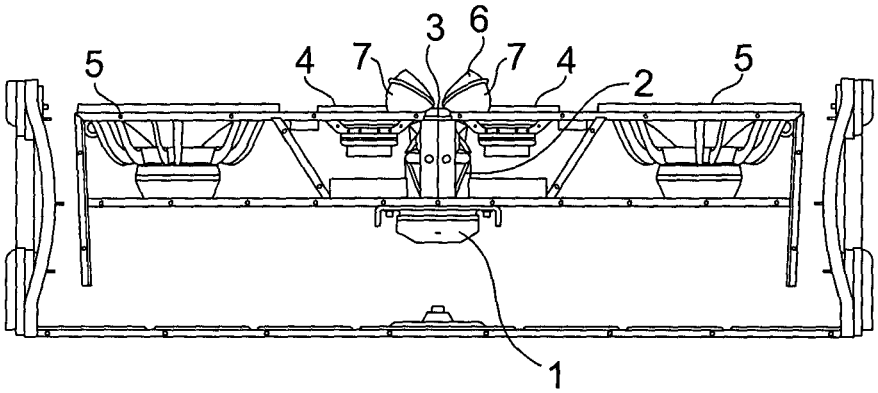
FIG. 1 represents a section of a loudspeaker system according to one embodiment of the invention.
Figure 2:
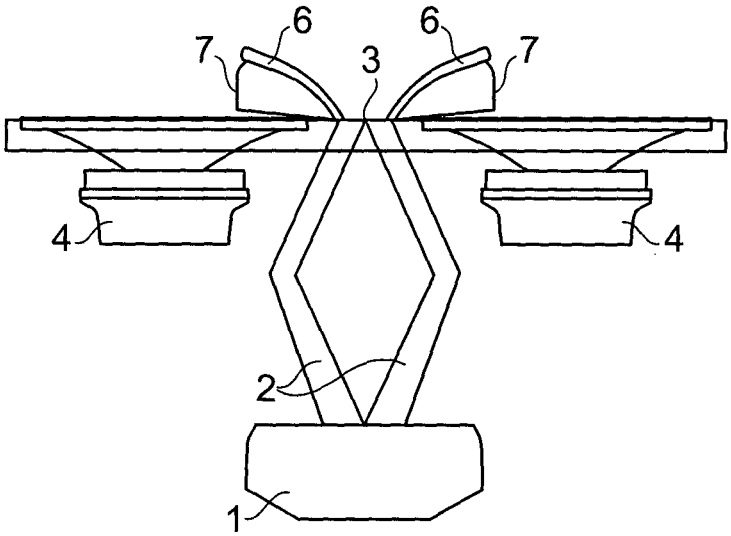
FIG. 2 represents a section of an orientable-flaps portion of this same loudspeaker system.

The loudspeaker system represented in FIG. 1 includes a K-shaped arrangement of the medium and treble transducers. When viewed from the front, this loudspeaker system is symmetrical with respect to the vertical plane crossing the system in its center. Starting from the centre of the front face, there are compression-chamber motors 1 mounted in line and coupled to superimposed waveguides 2 presenting, on the front face, an output in the form of a vertical longitudinal slot 3. On either side of this slot 3 are mounted, on the front face, medium transducers 4 located closest to the slot 3. On either side of these medium transducers 4 are mounted bass transducers 5 located proximate to the medium section.

The treble transducers 1 emit treble frequencies which consist of frequencies comprised between about 1 kHz and about 10 kHz. The medium transducers emit medium frequencies which consist of frequencies comprised between 200 Hz and about 1 kHz. The bass transducers emit bass frequencies which consist of frequencies lower than about 200 Hz.

On either side of the slot 3 have been added walls 6 which partially occult the medium transducers 4 and the orientation of which allows directing the high frequencies radiated by the treble transducer 1 over an angular sector corresponding to the directivity of the treble.

Herein, these walls 6 form orientable flaps. Thus, a mechanical setting of these orientable flaps 6 is implemented at the output of the waveguide 2 which is, in turn, connected to the orifice of the high-frequency transducer 1 which is herein constituted by a compression-chamber motor. The assembly is positioned between two or several medium transducers 4 mounted in direction radiation on a fixed plane, so that the complete device presents, at the front, a symmetry with respect to a vertical plane. Herein, the flaps 6 located at the output of the waveguides 2 are movable with a pre-selection of several orientations.

Herein, the flaps 6 are trapped in two respective cases 7. Each of the cases 7 extends around a space delimited by the lower face of the flap 6 turned away from the treble sound stream. Thus, the cases 7 protect the flaps 6 so that no external object can come into contact with the flap from below. Each of the cases 7 accommodates and also protects a system of rotation and of orientation pre-selection of the corresponding flap 6. In the present embodiment, each of the cases 7 presents a portion which overlaps a respective medium transducer. In this overlapping portion, each case 7 penetrates into the conical space delimited by the movable diaphragm of the considered medium transducer 4 and conforms to the shape of the diaphragm. Thus, this overlapping portion acts as a medium compression chamber.

Herein, the flaps 6 can be oriented individually so that it is possible to adopt, with the present system, an asymmetrical setting of the orientation of the sound stream, whether to the right or to the left depending on whether either of the flaps is disposed in the most raised position.

The rotation of the flaps 6 allows modifying the directivity of the treble over the operating range of the treble transducers, typically over the range frequencies above 800 Hz, however provided that the size of the flaps 6, in the open or closed mode, is large enough to ensure effective control. Indeed, it should be noted the loss of control of directivity as the flaps are tightened over a narrow angular sector because of physical dimensions that are too small at the output of the flaps.

To cancel this effect, a setting is introduced in the present system on the medium transducers which progressively activates these transducers by means of the DSP so as to acoustically compensate the loss of control of the treble in its lower portion.

In the present device, the medium 4 and treble 1 transducers operate in a common frequency range and a DSP component sets the magnitude and phase parameters of the treble 1 and medium 4 transducers over the common frequency range so that the directivity achieved by such parameters is the same as the directivity produced by the setting of the flaps 6 in the treble frequencies. For this purpose, are electronically combined by DSP at least the three source points which consist of the treble transducer 1 positioned at the center and the two identical medium transducers 4 located on either side thereof, so that, in a manner known per se, the resulting acoustic summation translates into the desired directivity.

In other terms, the present processing consists in adjusting the filtering, gain, phase and delay parameters, a delay equivalent to a phase shifting which depends on the frequency and a filtering equivalent to a magnitude which depends on the frequency as is the case in the present embodiment. This technique can be generalized at several additional source points which would, for example, be positioned on either side of the previously described device, and this, step-by-step, so as to gain control on still lower frequencies, and correlate it with the other sections. Thus, there is achieved a loudspeaker system whose directivity is variable not only by the variability of the orientation of the flaps, but also by the coordinated variability of the processing applied by the DSP component.

Herein, the treble transducers 1 are fed by a DSP component included in a control module which implements, apart from the digital signal processing, an amplification as well. The high-pass filter for transition between medium frequencies and high frequencies is set to a value Fc. The gain and the delay of the treble section are adjusted relative to the medium section so that the acoustic summation is the most favorable over the largest angular sector, 110° in the present example. A gain attenuation is implemented over a frequency range [Fc, Frc] relative to the nominal gain over the range of frequencies below Frc, by a value lower than 6 dB and varying according to the orientation of the flaps, Frc varying between Fc and Fc×2.5 according to the orientation of the flaps 6. An additional delay is applied to the treble section varying according to the orientation of the flaps. The medium transducers 4 are also fed by a control module producing the digital signal processing and the amplification, the number of these modules herein being one for each type of transducers but, as a variant, may be replaced with a plurality of control modules, for example, each associated to a respective transducer. Herein, the control module is disposed externally to the loudspeaker system represented in the figures, but, as a variant, it may be integrated in such a loudspeaker system.

If the medium transducers 4 are associated in parallel, the low-pass filter for transition between medium frequencies and high frequencies is set to Fc, a low-pass filter of overlap between the frequencies of the medium transducer 4 and the treble transducer 1 being set to the value Frc, Frc varying between Fc and Fc×2.5 according to the orientation of the flaps 6. Herein, a gain attenuation over the range [Fc, Frc] relative to the nominal gain over the frequency range below Frc is implemented with an attenuation value higher than 6 dB.

The present loudspeaker system consists of a system which can be carried by one or two person(s), by means of handles disposed at the ends of the present system.

Thus, in the present embodiment, the frequencies and attenuations given in the following table are implemented and given according to the desired directivity, these frequencies and attenuations being able to vary depending on the physical configuration of the transducers, the values herein being given for an Fc value equal to 1 kHz.

| Angular sector of the flaps | 70° | 90° | 110° |
|---|---|---|---|
| MEDIUM SECTION: | | | |
| Transition frequency Fc (Hz) | Fc | Fc | Fc |
| Crossover frequency Frc (Hz) | 2.5 × Fc | 2.5 × Fc | Fc |
| Attenuation on the range Fc-Frc | −11 dB | −14 dB | >−30 dB |
| TREBLE SECTION: | | | |
| Transition frequency Fc (Hz) | Fc | Fc | Fc |
| Attenuation on the range Fc-Frc | −3 dB | −2 dB | 0 dB |
| Additional coupling delay (ms) | −0.2 to −0.4 | −0.1 to −0.2 | 0 |

The described device combines a mechanical setting of the sound source by the use of orientable flaps 6 acting on the treble section, and a setting of the bass 5, medium 4 and treble 1 transducer by DSP component, implementing a frequency range common to at least two types of transducers, which common frequency range herein is variable depending on the orientation of the flaps of the treble 6. The mechanical and electronic parameters are adjusted so as to extend the control of directivity obtained in the treble to the medium frequencies reproduced by the medium transducers 4. Thus, the related magnitude and phase parameters of the transducers are changed by DSP component in order to obtain a match between the directivity of the treble and the medium. Thus, it is possible to adjust the directivity of a sound source containing such a device over an angular sector the extent of which ranges between 60° and 120° with a proper control from 300 Hz, up to frequencies exceeding 10 kHz.

The invention claimed is:

1. A sound system, comprising at least one treble sound transducer and at least one medium sound transducer, orientable flaps acting on a sound emission of the treble sound transducer so as to produce a sound emission directivity of the treble sound transducer according to a chosen angular sector, characterized in that it is configured so that the medium sound transducer and the treble sound transducer emit over a common frequency range and in that it comprises at least one digital signal processor type control module acting on a signal addressed to the treble sound transducer and on a signal addressed to the medium sound transducer so as to apply in the common frequency range at least one magnitude parameter on the treble sound transducer and/or on the medium sound transducer as well as at least one phase parameter on the treble sound transducer and/or on the medium sound transducer so as to produce a sound emission directivity of the pair constituted by the treble sound transducer and by the medium sound transducer according to the same chosen angular sector as the directivity produced by the orientable flaps.

2. The sound system according to claim 1, wherein the orientable flaps and the DSP-type control module are configured so that each of them generates a presence of the sound waves according to a substantially constant sound level within said chosen angular sector, the orientable flaps and the DSP-type control module being configured so that they attenuate the sound waves in every angle external to said chosen angular sector according to an attenuation higher than 6 dB relative to the maximum sound level within said chosen angular sector.

3. The sound system according to claim 1, wherein it is configured so that the common frequency range is variable according to the orientation of the orientable flaps.

4. The sound system according to claim 1, wherein it comprises at least two medium sound transducers and at least one treble sound transducer, the medium sound transducers being disposed on either side of the treble sound transducer.

5. The sound system according to claim 1, wherein it includes a case surrounding, at least partially, one of the flaps, said at least one of the flaps presenting a surface oriented opposite a sound stream emitted by said treble sound transducer and a surface oriented away from the sound stream emitted by said treble sound transducer, the case forming obstacle in front of the surface of the flap oriented away from the sound stream emitted by the treble sound transducer so as to protect this surface from an impact made by a foreign object.

6. The sound system according to claim 5, wherein said at least one medium sound transducer includes a substantially conical-shaped movable diaphragm and the case of said at least one flap is shaped so as to conform to a portion of the substantially conical shape of the diaphragm.

7. The sound system according to claim 1, wherein it constitutes a portable loudspeaker system.

8. The sound system according to claim 1, wherein it includes at least two bass sound transducers and said at least two bass sound transducers are disposed on either side of an assembly constituted by said at least one treble sound transducer and said at least two medium sound transducers.

9. The sound system according to claim 1, wherein it includes at least one waveguide which conveys sound waves emitted by the treble sound transducer.

10. The sound system according to claim 4, wherein it includes a slot through which are emitted the sound waves produced by the treble sound transducer, said at least two medium sound transducers being disposed on either side of the slot.

* * * * *